US009644815B2

(12) United States Patent
Thijssen et al.

(10) Patent No.: US 9,644,815 B2
(45) Date of Patent: May 9, 2017

(54) LUMINAIRE

(71) Applicant: PHILIPS LIGHTING HOLDING B.V., Eindhoven (NL)

(72) Inventors: Johannes Maria Thijssen, Eindhoven (NL); Denis Joseph Carel Van Oers, Eindhoven (NL); Noud Johannes Fleuren, Eindhoven (NL)

(73) Assignee: Philips Lighting Holding B.V., Eindhoven (NL)

( * ) Notice: Subject to any disclaimer, the term of this patent is extended or adjusted under 35 U.S.C. 154(b) by 0 days.

(21) Appl. No.: 15/036,059

(22) PCT Filed: Nov. 6, 2014

(86) PCT No.: PCT/EP2014/073859

§ 371 (c)(1),
(2) Date: May 11, 2016

(87) PCT Pub. No.: WO2015/067677

PCT Pub. Date: May 14, 2015

(65) Prior Publication Data

US 2016/0290594 A1 Oct. 6, 2016

(30) Foreign Application Priority Data

Nov. 11, 2013 (EP) ..... 13192268

(51) Int. Cl.
*F21V 1/00* (2006.01)
*F21V 11/00* (2015.01)
(Continued)

(52) U.S. Cl.
CPC ..... *F21V 5/02* (2013.01); *F21K 9/232* (2016.08); *F21V 3/02* (2013.01); *F21V 7/0091* (2013.01);
(Continued)

(58) Field of Classification Search
CPC ... F21V 5/02; F21V 15/01; F21V 3/02; F21V 19/003; F21V 7/0091; F21Y 2101/00; F21K 9/50; F21K 9/52; F21K 9/54
See application file for complete search history.

(56) References Cited

U.S. PATENT DOCUMENTS 5,890,794 A * 4/1999 Abtahi ..... B60Q 7/00 362/183
6,031,958 A * 2/2000 McGaffigan ..... B29D 11/00663 362/555
(Continued)

FOREIGN PATENT DOCUMENTS

CN 101649992 A 2/2010
CN 201739968 U 2/2011
(Continued)

*Primary Examiner* — Andrew Coughlin
*Assistant Examiner* — Alexander Garlen

(57) ABSTRACT

The present invention relates to a luminaire comprising one or more LED light sources (102) arranged within a light chamber that is enclosed by a translucent cover (302), having an inner surface (308), wherein the LED light source (102) is arranged to illuminate the inner surface (308) of the translucent cover (302). The translucent cover (302) comprises a prismatic optical structure (304) on the inner surface (308) for reflecting and/or refracting light from the LED light source (102) omni-directionally. The prismatic optical structure (304) is designed such that a direct view of the LED light source from outside the luminaire is obstructed by means of total internal reflection at the prismatic optical structure.

6 Claims, 3 Drawing Sheets

(51) Int. Cl.

| | |
|---|---|
| ***F21V 5/02*** | (2006.01) |
| ***F21V 3/02*** | (2006.01) |
| ***F21K 9/232*** | (2016.01) |
| ***F21V 7/00*** | (2006.01) |
| ***F21V 15/01*** | (2006.01) |
| ***F21V 19/00*** | (2006.01) |
| *F21Y 101/00* | (2016.01) |
| *F21Y 115/10* | (2016.01) |
| *F21Y 101/02* | (2006.01) |

(52) U.S. Cl.
CPC ..... *F21V 15/01* (2013.01); *F21V 19/003* (2013.01); *F21Y 2101/00* (2013.01); *F21Y 2101/02* (2013.01); *F21Y 2115/10* (2016.08)

(56) References Cited

U.S. PATENT DOCUMENTS

| | | | | |
|---|---|---|---|---|
| 2001/0040804 | A1* | 11/2001 | Marquardt | F21K 9/00 362/240 |
| 2011/0141747 | A1 | 6/2011 | Biar | |
| 2011/0310587 | A1* | 12/2011 | Edmond | F21K 9/135 362/84 |
| 2012/0092852 | A1 | 4/2012 | Doan et al. | |
| 2012/0262050 | A1 | 10/2012 | Fan | |
| 2013/0083555 | A1 | 4/2013 | Chen et al. | |
| 2013/0121002 | A1 | 5/2013 | Lin et al. | |
| 2013/0271989 | A1 | 10/2013 | Hussell et al. | |
| 2013/0294071 | A1 | 11/2013 | Boomgaarden et al. | |
| 2014/0268885 | A1* | 9/2014 | Randolph | F21K 9/50 362/650 |

FOREIGN PATENT DOCUMENTS

| | | | |
|---|---|---|---|
| CN | 201916723 | U | 8/2011 |
| CN | 202302905 | U | 7/2012 |
| CN | 202532288 | U | 11/2012 |
| CN | 202674988 | U | 1/2013 |
| CN | 202691724 | U | 1/2013 |
| CN | 103115326 | A | 5/2013 |
| JP | 2004335482 | A | 11/2004 |
| JP | 2008262758 | A | 10/2008 |
| JP | 2012182117 | A | 9/2012 |
| JP | 2012204187 | A | 10/2012 |
| JP | 2012248437 | A | 12/2012 |
| WO | 2010079439 | A1 | 7/2010 |
| WO | 2012035841 | A1 | 3/2012 |

* cited by examiner

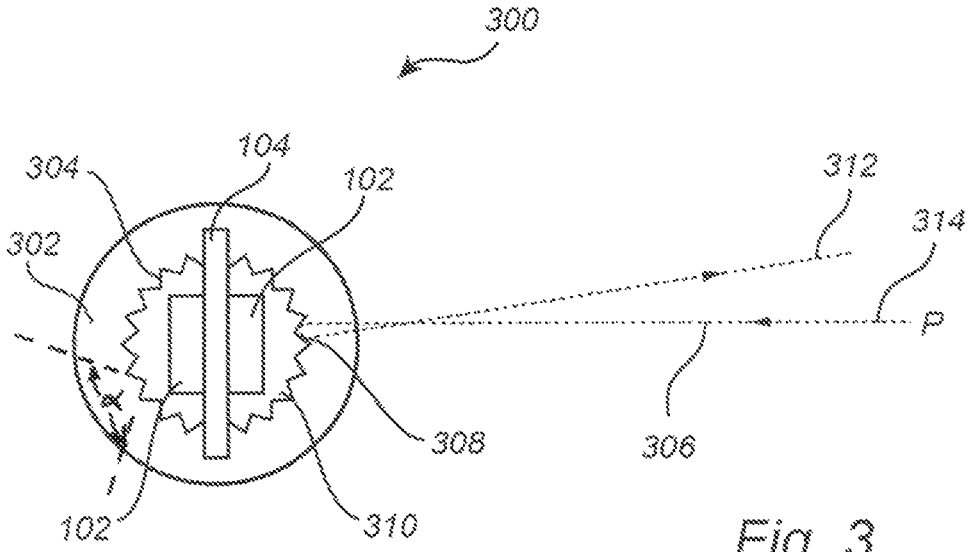
Fig. 3
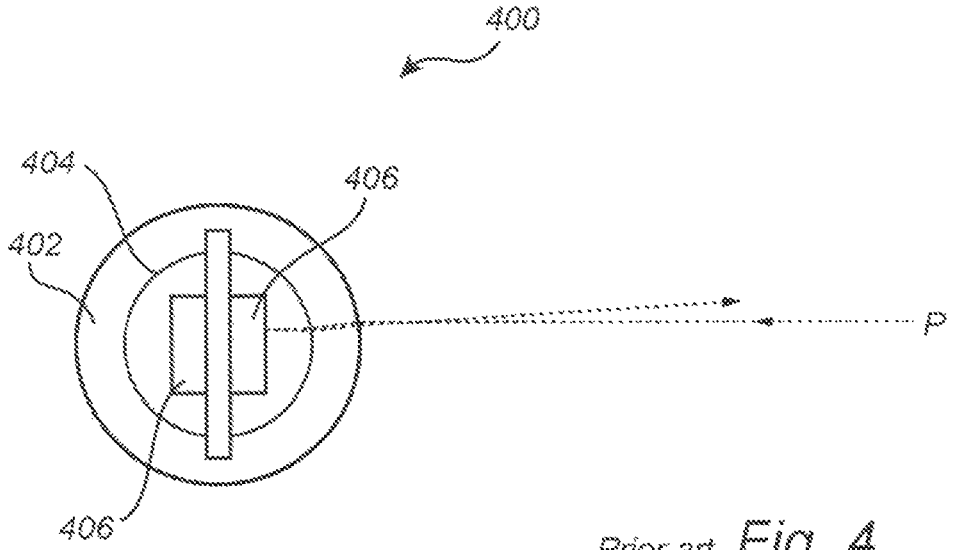
Prior art Fig. 4

LUMINAIRE

CROSS-REFERENCE TO PRIOR APPLICATIONS

This application is the U.S. National Phase application under 35 U.S.C. §371 of International Application No. PCT/EP2014/073859, filed on Nov. 6, 2014, which claims the benefit of European Patent Application No. 13192268.4, filed on Nov. 11, 2013. These applications are hereby incorporated by reference herein.

FIELD OF THE INVENTION

The present invention relates to a luminaire comprising a LED light source arranged within a light chamber that is enclosed by a translucent cover.

BACKGROUND OF THE INVENTION

Incandescent light sources produce light using a filament wire which is heated by an electric current being driven through it until it glows. The filament is commonly housed within a glass or quartz bulb filled with inert gas or that is evacuated to protect the heated filament from oxidation and other processes that may be damaging. In a halogen luminaire, filament evaporation is further prevented by the usage of a chemical process for redepositing metal vapour onto the filament, whereby its lifetime is extended considerable. Hence, halogen luminaires are commonly used for lighting applications.

Light emitting diodes (LEDs) are currently among the most efficient light sources available today. Luminaries comprising LED light sources consume less energy than incandescent light sources. LEDs also have a longer lifespan than conventional light sources and need to be replaced less frequently, having the advantage that the light source may be integrated in the luminaire, without using sockets for easy replacement.

To provide LED luminaires that mimic the light emission distribution and appearance of incandescent light sources such as halogen luminaires is however problematic for a number of reasons.

US-2012/0262050 discloses a LED light with a housing comprising prisms which are arranged such that the visual effects of the LED lights is improved.

There is, however, a need to further improve the performance and appearance of LED luminaires that mimics the visual appearance and light emission of incandescent light sources such as clear halogen capsule lamps.

SUMMARY OF THE INVENTION

An object of the present invention is to solve or at least to reduce the problems discussed above.

In particular according to a first aspect of the invention, a luminaire is provided that comprises a light chamber, a translucent cover enclosing the light chamber, the translucent cover having an inner surface and an outer surface, and one or more LED light sources arranged within the light chamber to illuminate the inner surface of the translucent cover.

The translucent cover comprises a material having a first refractive index, and the light chamber comprises a material having a second refractive index. The translucent cover further comprises a prismatic optical structure on the inner surface, the prismatic optical structure having a top angle that is equal to or smaller than $2\times[90-\arcsin(n_2/n_1)]$.

The prismatic optical structure that is present on the inner surface of the translucent cover is arranged to reflect and/or refract light from the LED light source omni-directionally. It is furthermore arranged to obstruct direct viewing of the LED light source from an outside of the luminaire.

An advantage is that a LED luminaire with improved performance such as larger output of light and longer lifetime compared to traditional halogen based luminaires and improved visual appearance are provided. Light from the LED is, by using the translucent cover having an optical structure that reflect and/or refract light from the LED light source, redistributed such that the light distribution from the LED luminaire is improved. Hence a luminaire is provided that better mimics incandescent light sources such as halogen luminaires. The fabrication of the LED luminaire is furthermore simplified due to the few components.

The wording translucent is to be understood as permitting the passage of light. The translucent cover may therefore comprise a portion that is clear, in other words transparent to light, and/or a portion that is transmitting and diffusing light such that objects within the optical cover cannot be seen clearly from outside the translucent cover.

Hence, translucent is to be understood as "permitting the passage of light" and a translucent material may either be clear (transparent) or transmitting and diffusing light so that objects beyond cannot be seen clearly.

Transparent is to be understood as "able to be seen through".

The prismatic optical structure allows for efficient redistribution of light emitted through the translucent cover of the LED luminaire such that a light distribution that mimics the emission from a halogen luminaire is obtained. The LED luminaire allows the relative large light emitting area of the LED to be visible as a discontinuous area when viewing the LED luminaire from outside the translucent cover. In other words, the LED luminaire better mimics the visual appearance of an incandescent luminaire.

The optical structure is arranged on the inner surface of the translucent cover, so that it is protected by the translucent cover which reduces the probability that wear and/or contamination affects the performance of the LED luminaire. Thereby a LED luminaire with increased durability is obtained.

The LED light source is arranged within the light chamber that is enclosed by the translucent cover, and the optical structure on the inner surface of the translucent cover is arranged such that direct viewing of the LED light source from an outside of the LED luminaire is obstructed by means of total internal reflection at the prismatic optical structure. This reduces problems such as glare which may cause discomfort or disability for a person viewing the LED luminaire. This further reduces problems associated with the light emitting area of the LED being relatively large as compared to a conventional filament of an incandescent light source.

Total internal reflection (TIR) is an optical effect that occurs when a ray of light reaches a boundary between a first and a second medium at an angle larger than a critical angle, with respect to the normal of the boundary surface. For TIR to occur it is needed that the refractive index of the first medium is larger than the refractive index of the second material, i.e. in order for the light ray to be totally reflected at the boundary such that no light propagate beyond the boundary and all light is substantially reflected at the boundary.

The translucent cover may be cylindrical. This allows for easy fabrication of the translucent cover. The cylindrical shape of the translucent cover further provides efficient redistribution of light emitted through the translucent cover such that a light distribution that mimics the emission from a halogen luminaire is obtained, i.e. light may be emitted more uniformly in radial directions of the cylinder. The cylindrical shape may further provide reduced light intensity in directions being perpendicular to the radial directions of the cylinder. This provides a light distribution which resembles the emission pattern of an incandescent light source such as a halogen luminaire.

The LED light source may comprise at least two LEDs arranged within the translucent cover. This is advantageous as the light output power of the LED luminaire is improved.

Two LEDs may be arranged back to back on a two-sided PCB, wherein the PCB is in thermal contact with a heat conducting material. This arrangement allows for efficient fabrication of the LED luminaire. Improved thermal management and uniformity of the light emission are further obtained.

Alternatively or additionally, an optical structure may be arranged on the outer surface of the translucent cover.

An advantage is that a LED luminaire with improved performance such as larger output of light and longer lifetime compared to traditional halogen based luminaires and improved visual appearance are provided.

Light from the LED is, by using a translucent cover that reflect and/or refract light from the LED light source, redistributed such that the light emission from the LED luminaire is improved.

The optical structure that is arranged on the outer surface of the translucent cover may comprise alternating transparent and scattering portions. Such an arrangement allows for efficient redistribution of light from within the LED luminaire such that its light emission mimics that of a filament type incandescent luminaire. This arrangement further reduces problems such as glare which may cause discomfort or disability for a person viewing the LED luminaire.

It is noted that the invention relates to all possible combinations of features recited in the claims.

BRIEF DESCRIPTION OF THE DRAWINGS

This and other aspects of the present invention will now be described in more detail, with reference to the appended drawings showing embodiments of the invention.

As illustrated in the figures, the sizes of layers and regions are exaggerated for illustrative purposes and, thus, are provided to illustrate the general structures of embodiments of the present invention. Like reference numerals refer to like elements throughout.

FIG. 3 is a schematic view of LED luminaire according to one embodiment of the present invention.

FIG. 4 is a schematic view of a prior art LED luminaire.

DETAILED DESCRIPTION OF THE EMBODIMENTS

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

The basic idea of this invention is to provide a LED luminaire that mimics incandescent light sources such as halogen luminaires. This is achieved by providing a LED luminaire that comprises one or more LED light sources, a translucent cover having an inner and an outer surface. The LED light source(s) is/are further arranged to illuminate the inner surface of the translucent cover, wherein the translucent cover comprises an optical structure arranged to reflect and/or refract light from the LED light source omni-directionally. Light from the LED is, by using a translucent cover that reflect and/or refract light from the LED light source, redistributed such that the light emission from the LED luminaire is improved. Due to the few components the fabrication of the LED luminaire is furthermore simplified.

Figure 1:
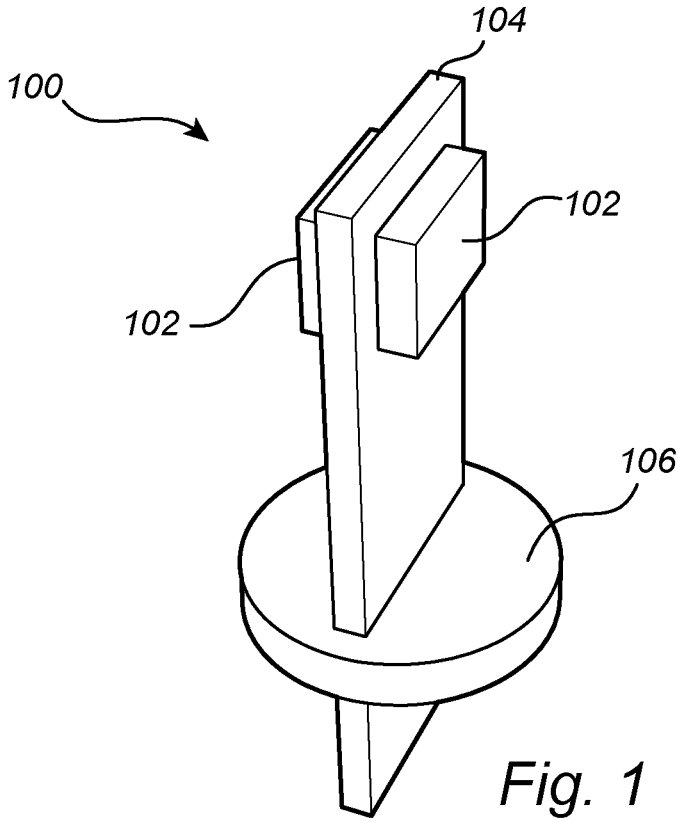
FIGS. 1 and 2 are schematic views of a LED luminaire according to one embodiment of the invention.
Figure 2:
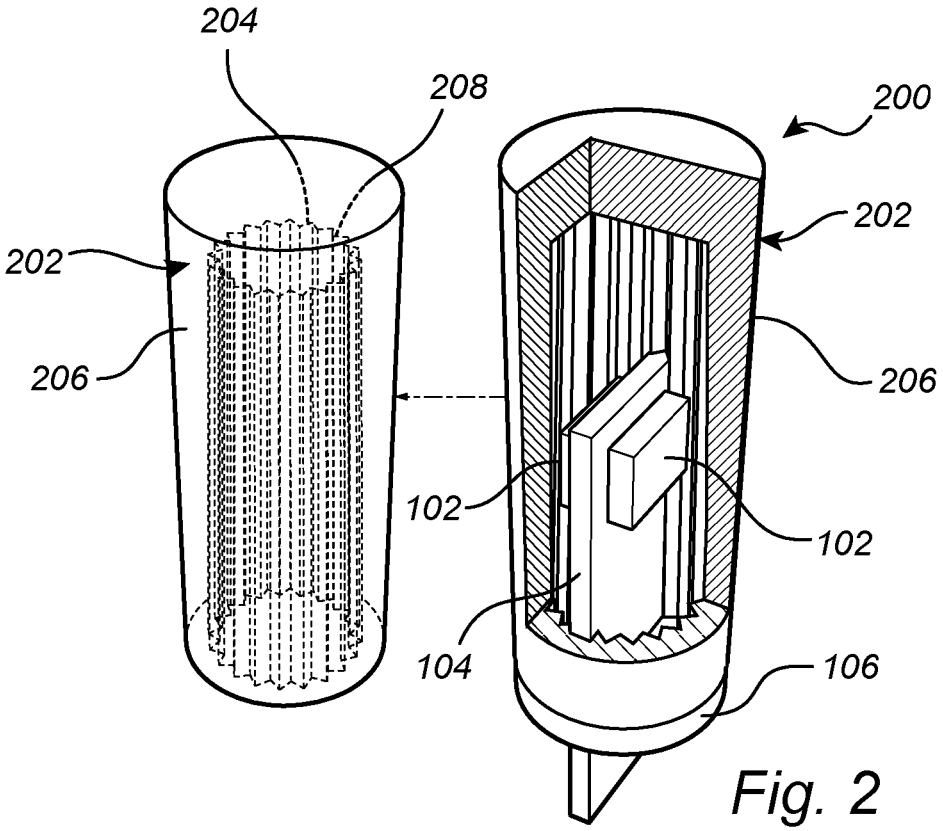

FIGS. 1 and 2 illustrate an embodiment of a LED luminaire 100 according to the present invention. In FIG. 1, for clarity, the translucent cover is not shown. The LED luminaire 100 comprises two LEDs 102 placed back-to-back on a two-sided printed circuit board (PCB) 104. The arrangement of the LEDs allow for efficient fabrication of the LED luminaire 100. The LEDs 102 are here positioned on the PCB such that light is emitted in the two opposite directions and show Lambertian emission patterns. Hence light emission having a larger angular distribution is achieved.

The PCB 104 is further in thermal contact with a thermally conducting material 106 such that improved thermal management is obtained. According to this embodiment the thermally conducting material forms a base of the LED luminaire 100. The thermally conductive material 106 is for simplicity shown as a disc. The person skilled in the art should understand that the thermally conductive material 106 may be of any shape such as a cylinder, as long as it is suitable for reducing the temperature of the PCB 104. The assembly of the LED luminaire is thereby simplified as a translucent cover 202 can be arranged directly on the PCB 104. The translucent cover 202 may for instance be formed by injection moulding, preferable comprising a rim facilitating easy fixation on the base of the LED luminaire 100. The interior of the LED luminaire 100 may thereby be sealed such that it is protected. The LED luminaire may further be easily fixed on for instance a luminaire tube in which wiring may be integrated. A mechanically stable LED luminaire is thereby provided.

It should, however, be noted that the LED luminaire may also comprise one LED. According to another embodiment the LED luminaire comprises more than two LEDs.

In another embodiment of the present invention the LED luminaire may comprise triangular (each 120 degrees), rectangular (each 90 degrees) or multiple placement of the LEDs within the LED luminaire such that the rotational symmetry of the emission from the LED luminaire is improved. In such an arrangement the light emission from the LED luminaire may be more homogeneous in the angular distribution and/or provide a larger total light intensity.

The PCB may in another embodiment be a single sided PCB.

FIG. 2 illustrates the embodiment with the translucent cover 202 present. Hence, the LED luminaire 100 comprises two LED light sources 102, a translucent cover 202 having an inner 208 and an outer surface 206, wherein the LED light sources 102 are arranged to illuminate the inner surface 208 of the translucent cover 202. The translucent cover 202 comprises an optical structure 204 that is prismatic. The optical structure 204 is arranged to reflect and/or refract light from the LED light source 102. Light is thereby redistributed such that the light emission from the LED luminaire 100 is improved. An omni-directional LED luminaire is thereby obtained.

The optical structure 204 is arranged on the inner surface 208 of the translucent cover 202, and extends along the long axis of the translucent cover 202. An advantage being that the light in-coupling into the optical structure is increased. The optical structure 204 is further protected by the translucent cover 202 which reduces the probability that wear and/or contamination affects the performance of the LED luminaire 200. Thereby a LED luminaire 200 with increased durability is obtained.

The translucent cover 202 is in this embodiment cylindrical. This allows for easy fabrication of the translucent cover 202. The cylindrical shape of the translucent cover 202 further provides efficient redistribution of light emitted through the translucent cover 202 such that a light distribution that mimics the emission from a halogen luminaire is obtained, i.e. light may be emitted more uniformly in radial directions of the cylinder. The cylindrical shape may further provide reduced light intensity in directions being perpendicular to the radial directions of the cylinder. This provides a light distribution which is resembles the emission pattern of an incandescent light source such as a halogen luminaire.

The translucent cover may in another embodiment comprise an optical structure that covers a portion of the translucent cover. The emission profile of the LED luminaire may thereby be tailored during the design of the LED luminaire by adjusting the size of the portion that the optical structure covers. The optical structure may additionally cover the top of the translucent cover.

The emission profile of the LED luminaire may further be tailored by adjusting the shape of the translucent cover. The translucent cover may for instance have a disk shape.

The translucent cover may in another embodiment be dome shaped. The optical structure may extend along the long axis of the dome shaped translucent cover to the top of the translucent cover. An advantage of this embodiment is that the light in-coupling into the optical structure may be increased. Two LED light sources 102 are in this embodiment arranged within the translucent cover 202 and the optical structure 204 is arranged such that direct viewing of the LED light sources 102 from an outside of the LED luminaire 200 is obstructed. This reduces problems such as glare which may cause discomfort or disability for a person viewing the LED luminaire 200.

FIG. 3 illustrates an embodiment of a LED luminaire 300 according to the present invention. The translucent cover 302 comprises an optical structure 304 that is prismatic. This allows for efficient redistribution of light emitted through the translucent cover of the LED luminaire such that a light distribution that mimics the emission from a halogen luminaire is obtained. The arrangement allows the relative large light emitting area of the LED to be visible as a discontinuous area when viewing the LED luminaire from outside the translucent cover. In other words, the LED luminaire better mimics the visual appearance of an incandescent luminaire.

The angle of the prismatic optical structure 304 is chosen such a that when viewing the LED luminaire 300, direct viewing of the LED light sources 102 is obstructed by means of total internal reflection (TIR) at the optical structure 304. TIR occurs when a ray of light 306 reaches the inner surface 308 between the translucent cover 302, having a refractive index of n1, and a light chamber 310 having a refractive index of n2 at an angle θ larger than a critical angle θcritical that is equal to arcsin(n2/n1), with respect to the normal of the inner surface 308. At such angles θ the ray of light 306 is totally reflected at the inner surface 308 such that no light will propagate beyond the inner surface and substantially all light is reflected at the inner surface 308.

TIR is achieved for a top angle (α) of the prismatic optical structure equal to or smaller than 2×(90−θcritical). For example, in this embodiment the translucent cover 302 is made of polymethylmethacrylate (PMMA), having a refractive index n1 of 1.480 and the light chamber 310, within which the LEDs and PCB are housed, comprise air having a refractive index n2 of 1. This results in a critical angle θcritical that is equal to 42.5 degrees. Hence, TIR is achieved using a top angle of the prismatic optical structure 304 equal to or smaller than 95 degrees, such as smaller than 90 degrees. As a result the ray of light 306 is reflected back, but redirected by the optical structure 302 such that a reflected ray of light 312 propagates in an angle relative to the ray of light 306. Direct viewing at for instance the position P of the LED light sources 102 is thereby mitigated.

According to another embodiment of the present invention the translucent cover may be of polycarbonate (PC) having a refractive index of n1 of 1.585. This results in a critical angle θcritical that is equal to 39.1 degrees. The top angle of the prismatic optical structure should then be equal to or smaller than 102 degrees, such as smaller than 100 degrees to achieve TIR.

It should be noted that these numbers are calculated assuming a ray of light 302 that is send in perpendicular to an imaginary triangular base of the prismatic structure 304.

According to a preferred embodiment the top angle of the prismatic structure is about 10 degrees smaller than the required TIR angle (θcritical) which is set by the materials used.

FIG. 4 illustrates, for reference, a prior art LED luminaire 400, wherein the translucent cover 402 comprises an optical structure 404, which is not arranged to reflect and/or refract light from the LED light sources 402. The LED light sources 406 are thereby directly viewable at the position P, which results in glare that may cause discomfort or disability for a person viewing the LED luminaire 400.

It should further be noted that a LED luminaire with a translucent cover according to the above embodiments of the present invention shows a non-uniform light emission distribution. The light emission of the LED luminaire results in light emission patterns that vary in their shape depending on the viewing direction of the LED luminaire. This is a result from that the two LEDs 102 are arranged to emit light in two opposite directions. For example, the emission pattern may contain a main central spot with higher intensity that is observed to be centred at the light emitting surface of one of the LEDs when viewing the LED luminaire in a direction being substantially parallel to the normal of the light emitting surface of that LED. Two separated lobes are, however, observed when viewing the LED luminaire in a direction that is perpendicular to the above given direction. LED luminaires are thereby provided which have a large angular distribution but also an intensity distribution that mimics that of a filament in an incandescent light source, i.e., similar emission patterns are observed when viewing the filament along or perpendicular to the extension of the filament.

Figure 5A:
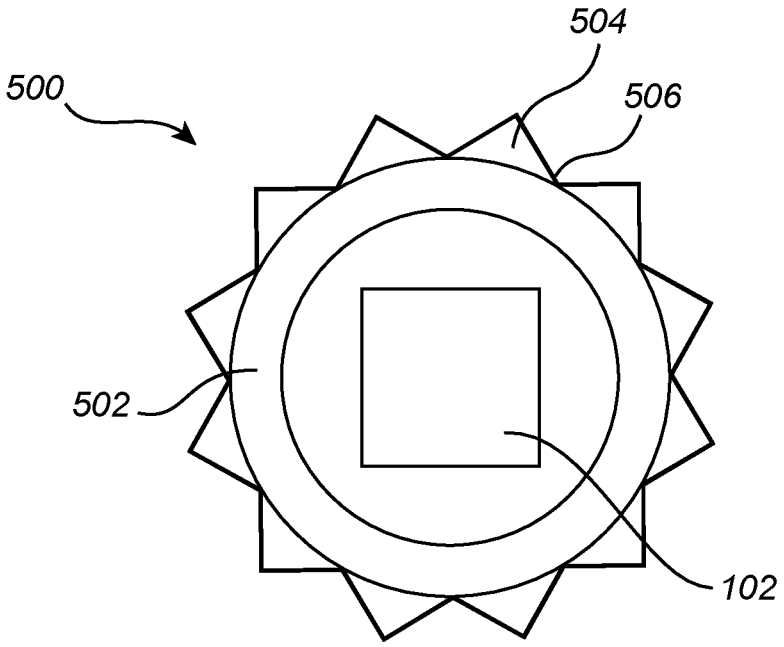
FIG. 5*a* is a schematic cross-sectional view of a LED luminaire according to another embodiment of the present invention.

FIG. 5*a* shows a cross-sectional view of a LED luminaire 500 according to another embodiment of the present invention. The LED luminaire 500 comprises a LED light source

102, a translucent cover 502, and an optical structure 504. The optical structure 504 is arranged on an outer surface 506 of the translucent cover 502. An advantage is that a LED luminaire with improved performance such as larger output of light and longer lifetime compared to traditional halogen based luminaires and improved visual appearance are provided. Light from the LED light source 102 is, by using a translucent cover 502 that reflect and/or refract light from the LED light source 102, redistributed such that the light emission from the LED luminaire 500 is improved.

Figure 5B:
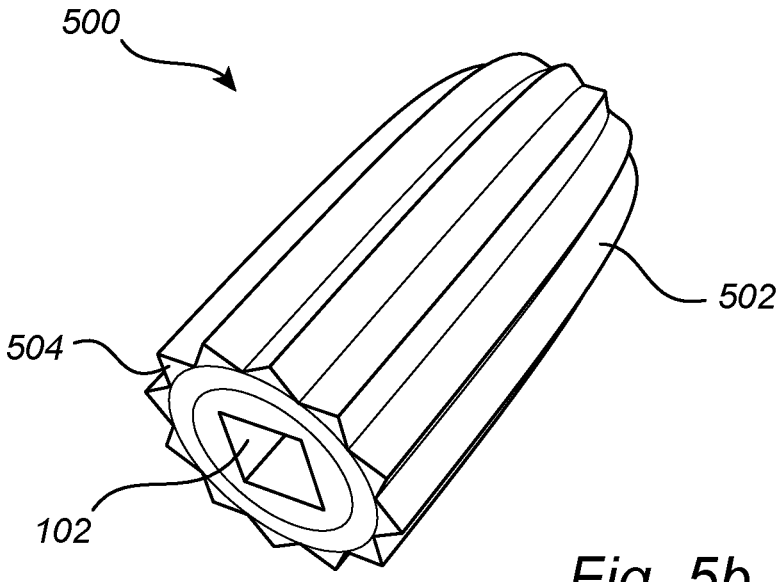
FIG. 5*b* is a schematic angled view of a LED luminaire according to another embodiment of the present invention.

FIG. 5*b* shows an angled view of the LED luminaire 500. It can be seen from the figure that the optical structure 504 extends along the long axis of the dome shaped translucent cover 502 to the top of the translucent cover 502. An advantage of this embodiment is that the LED light source 102 may, as disclosed in FIGS. 5*a* and 5*b*, be placed such that it emits light primarily in a direction parallel to a long axis of the translucent cover 502. By providing an optical structure 504 along the full length of the translucent cover 502 light from the LED light source 102 is more effectively reflected and refracted by the optical structure 504. This improves the light output from the LED luminaire 500 such that a more efficient luminaire is provided. The optical structure 504 according to this embodiment further provides a LED luminaire 500 for which the relative large light emitting area of the LED light source 102 is visible as a discontinuous area when viewing the LED luminaire 500 from outside the translucent cover 502. In other words, a visual appearance comprises lines having larger emission intensity is obtained. Hence a light intensity distribution is achieved which mimics that of a filament in an incandescent light source.

The prismatic structure may in another embodiment not be extended to the top of the cover.

According to an embodiment of the present invention the optical structure of the LED luminaire comprises alternating transparent and scattering portions. Such an arrangement allows for efficient redistribution of light from within the LED luminaire such that its light emission mimics that of a filament type incandescent luminaire. Such a LED luminaire reduces problems such as glare which may cause discomfort or disability for a person viewing the LED luminaire.

The person skilled in the art realizes that the present invention by no means is limited to the preferred embodiments described above. On the contrary, many modifications and variations are possible within the scope of the appended claims.

For example, the flanks of the prismatic structure on the outside of the translucent cover comprise alternating transparent and scattering portions. Such an arrangement allows for efficient redistribution of light within the LED luminaire such that its light emission mimics that of a filament type incandescent luminaire. This arrangement further reduces problems such as glare which may cause discomfort or disability for a person viewing the LED luminaire.

It should be noted that the plurality of LED may also be placed arbitrarily as long as efficient light emission from the LED luminaire is achieved.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A luminaire comprising:

a light chamber, a translucent cover enclosing the light chamber, the translucent cover having an inner surface, and a LED light source arranged within the light chamber to illuminate the inner surface of the translucent cover, wherein the translucent cover comprises a material having a first refractive index (n1), and wherein the light chamber comprises a material having a second refractive index (n2), and wherein the translucent cover comprises a prismatic optical structure on the inner surface, the prismatic optical structure having a top angle that is equal to or smaller than $2\times[90-\arcsin(n2/n1)]$.

2. The luminaire according to claim 1, wherein the translucent cover is cylindrical.

3. The luminaire according to claim 1, wherein the LED light source comprises at least two LEDs arranged within the translucent cover.

4. The luminaire according to claim 3, wherein two LEDs are arranged back to back on a two-sided PCB, and wherein the PCB is in thermal contact with a heat conducting material.

5. A luminaire comprising:

a light chamber, a translucent cover enclosing the light chamber, the translucent cover having an inner surface, and a LED light source arranged within the light chamber to illuminate the inner surface of the translucent cover, wherein the translucent cover consists of a material having a first refractive index (n1), and wherein the light chamber comprises a material having a second refractive index (n2), and wherein the translucent cover comprises a prismatic optical structure on the inner surface, the prismatic optical structure having a top angle that is equal to or smaller than $2\times[90-\arcsin(n2/n1)]$.

6. The luminaire according to claim 5, wherein the translucent cover is a one-piece molded cover, formed by an injecting moulding process.

* * * * *